US005536191A

United States Patent [19]

Lin

[11] Patent Number: 5,536,191

[45] Date of Patent: Jul. 16, 1996

[54] LIFE-SAVING ASSISTANCE DRIVE

[76] Inventor: Pi-Hsiang Lin, No. 14, Lane 233, Kuo-An Street, Tainan City, Taiwan

[21] Appl. No.: 455,729

[22] Filed: May 31, 1995

[51] Int. Cl.[6] ..... B63C 9/08

[52] U.S. Cl. ..... 441/89; 441/96; 441/106

[58] Field of Search ..... 441/1, 6, 11, 13, 441/16, 17, 18, 20, 96, 80, 88, 89, 106, 108, 125, 129

[56] References Cited

U.S. PATENT DOCUMENTS

| | | | |
|---|---|---|---|
| 1,620,421 | 3/1927 | Wilson | 441/88 |
| 4,626,221 | 12/1986 | Rocco | 441/108 |
| 5,030,152 | 7/1991 | Carr et al. | 441/89 |

FOREIGN PATENT DOCUMENTS

| | | | |
|---|---|---|---|
| 93014971 | 8/1993 | WIPO | 441/89 |

*Primary Examiner*—Stephen Avila
*Attorney, Agent, or Firm*—Panitch Schwarze Jacobs & Nadel

[57] ABSTRACT

The invention herein provides a kind of life-saving assistance device that includes an electroluminescent component that constitutes an illumination emission source mounted on string netting enshrouded on an inflatable balloon, wherein the aforesaid inflatable balloon can be packed into a satchel attached to a securing belt, and there is a battery case on the aforesaid securing belt and in the aforesaid battery case is a electric current driver device and switch for a battery-driven electroluminescent component illumination source. The securing belt can be worn by any user whatsoever and utilized to pump air into the inflatable balloon of the invention herein to provide a kind of device that emits illumination at night to indicate the exact location of rescue victims.

2 Claims, 7 Drawing Sheets

LIFE-SAVING ASSISTANCE DRIVE

BACKGROUND OF THE INVENTION

1. Field of the Invention

The invention herein relates to an life-saving assistance device, specifically a kind that illuminates in the night and, furthermore, is capable of indicating the physical position of the rescue victim.

2. Description of the Related Art

During the occurrence of human disasters on mountains or at sea, the rescue personnel search for victims are faced with an extremely arduous task that is even more difficult due to perilous terrain and complicated geography as well as the vast wide expanse of territory involved. Furthermore, rescue missions are not only conducted in the day, but also at night, when rescue work is most urgent and, furthermore, even more difficult than daytime rescues. Therefore, the more difficult the search operation, the harder it is to render assistance to the survivors, which leads to an increase in the number of victims.

SUMMARY OF THE INVENTION

The major objective of the invention herein is to provide a kind of improved life-saving assistance device that includes an inflatable balloon on which is an air delivery opening and a shroud of string netting. an illumination emission source consisting of an electroluminescent component which is, furthermore, mounted on the enshrouding string netting, there is an electric current wire on the electroluminescent component that is connected to the necessary electric power. The uninflated inflatable balloon packed into a satchel and a securing belt is utilized for fastening to the body of any user whatsoever. During normal utilization, air is delivered into the inflatable balloon and the switch on the battery case controls the illumination of the electroluminescent component.

BRIEF DESCRIPTION OF THE DRAWINGS

The accompanying drawings below dwell on the other features and advantages of the invention herein as elaborated in the detailed description of the invention herein.

DETAILED DESCRIPTION OF THE PREFERRED EMBODIMENTS

Similar elements referred to in the detailed description of the preferred embodiments herein shall be indicated by identical reference numbers throughout the disclosure.

Figure 1:
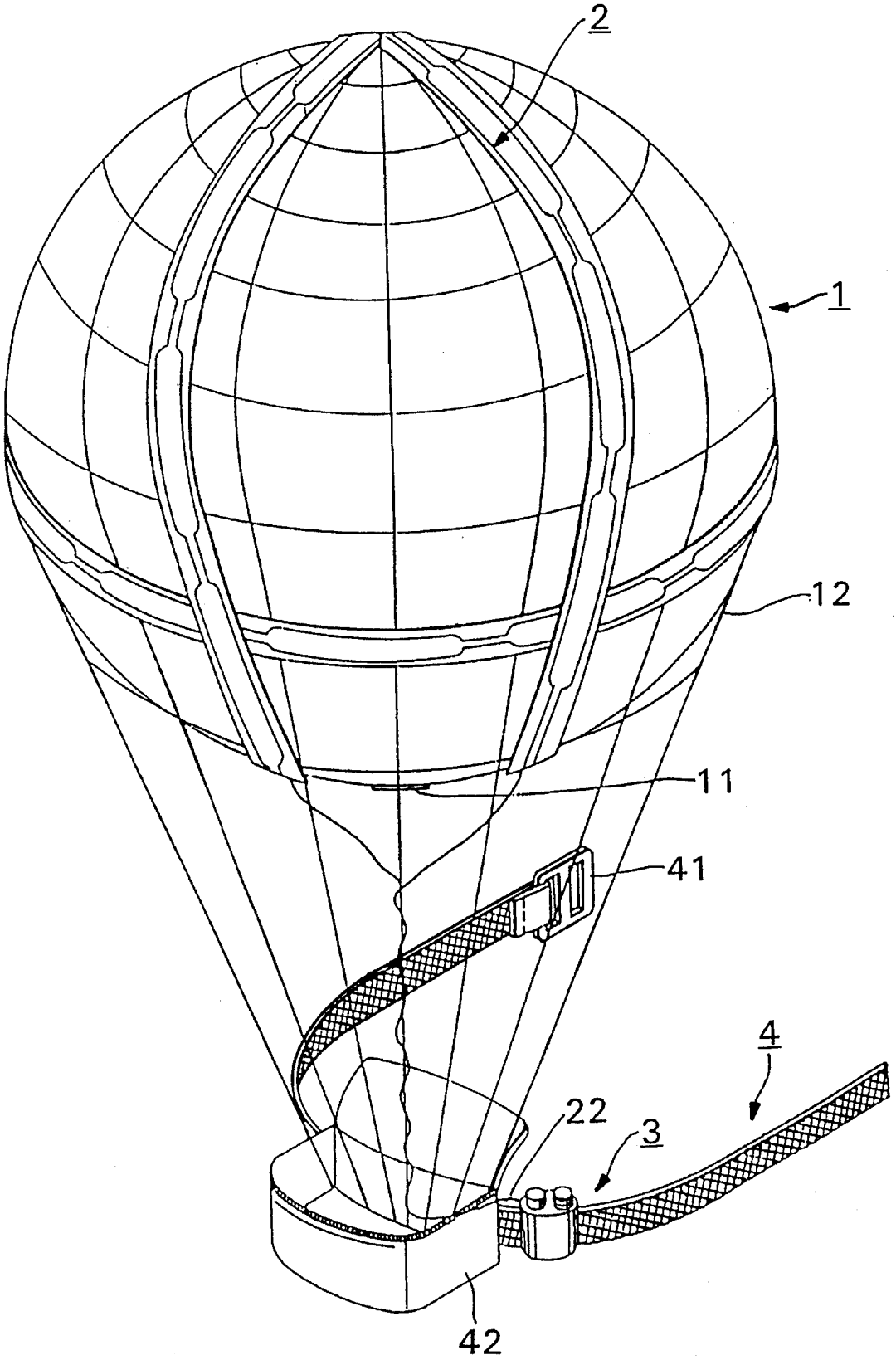
FIG. 1 is an isometric drawing of the first preferred embodiment of the invention herein.

As indicated in FIG. 1, the first preferred embodiment of the life-saving assistance device invention herein has an inflatable balloon (1), an illumination emission source (2), a battery case (3) and a securing belt (4), of which:

The aforementioned inflatable balloon (1) is constructed out a lightweight and, furthermore, tear-resistant material, on which is an air delivery opening (11), with a layer of string netting (12) enshrouded around the external spherical surface of the inflatable balloon (1).

Figure 2:
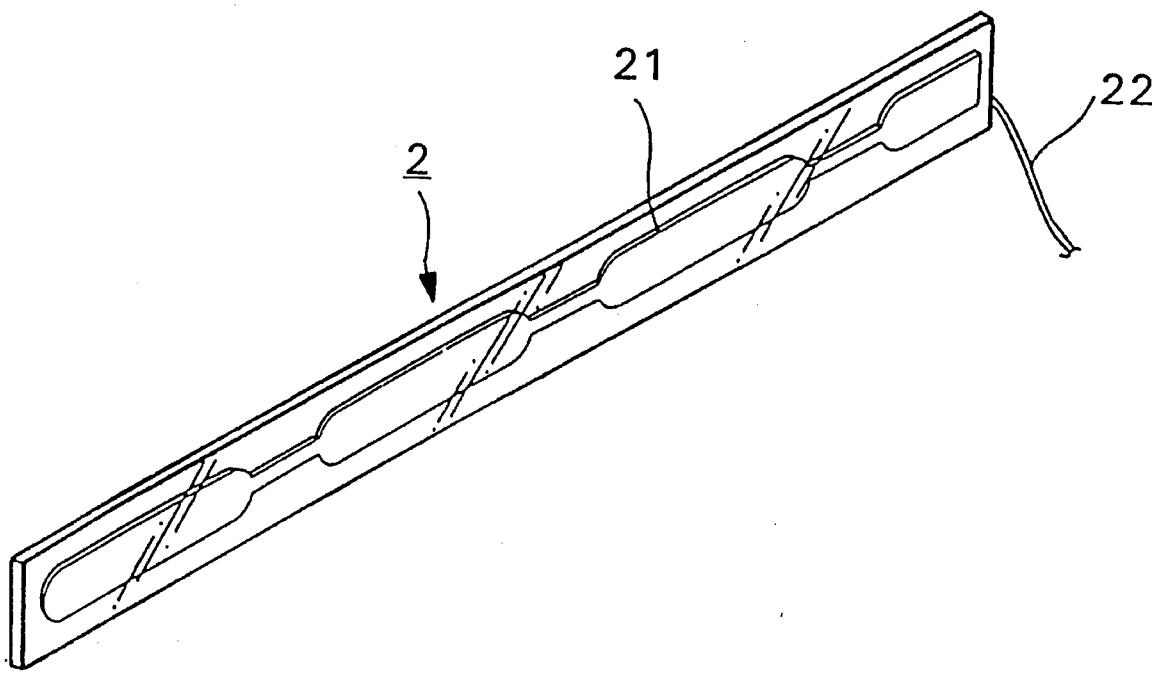
FIG. 2 is an isometric drawing of the illumination emission source of the first preferred embodiment of the invention herein.

As indicated in FIG. 2, the aforementioned illumination emission source (2) is mainly comprised of electroluminescent component (21) (an electroluminescent lamp also referred to in the abbreviated expression as EL) that can be fabricated from commonly available materials; however, in the preferred embodiments of the invention herein. the electroluminescent effect is achieved by an indium tin oxide conductor laminated within a plastic layer; the aforesaid electroluminescent component (21) is in the general physical form of an extremely thin strip, with the length and the width cut according to requirements, and an electric current wire (22) is attached for connection to the necessary electric power source.

Figure 3:
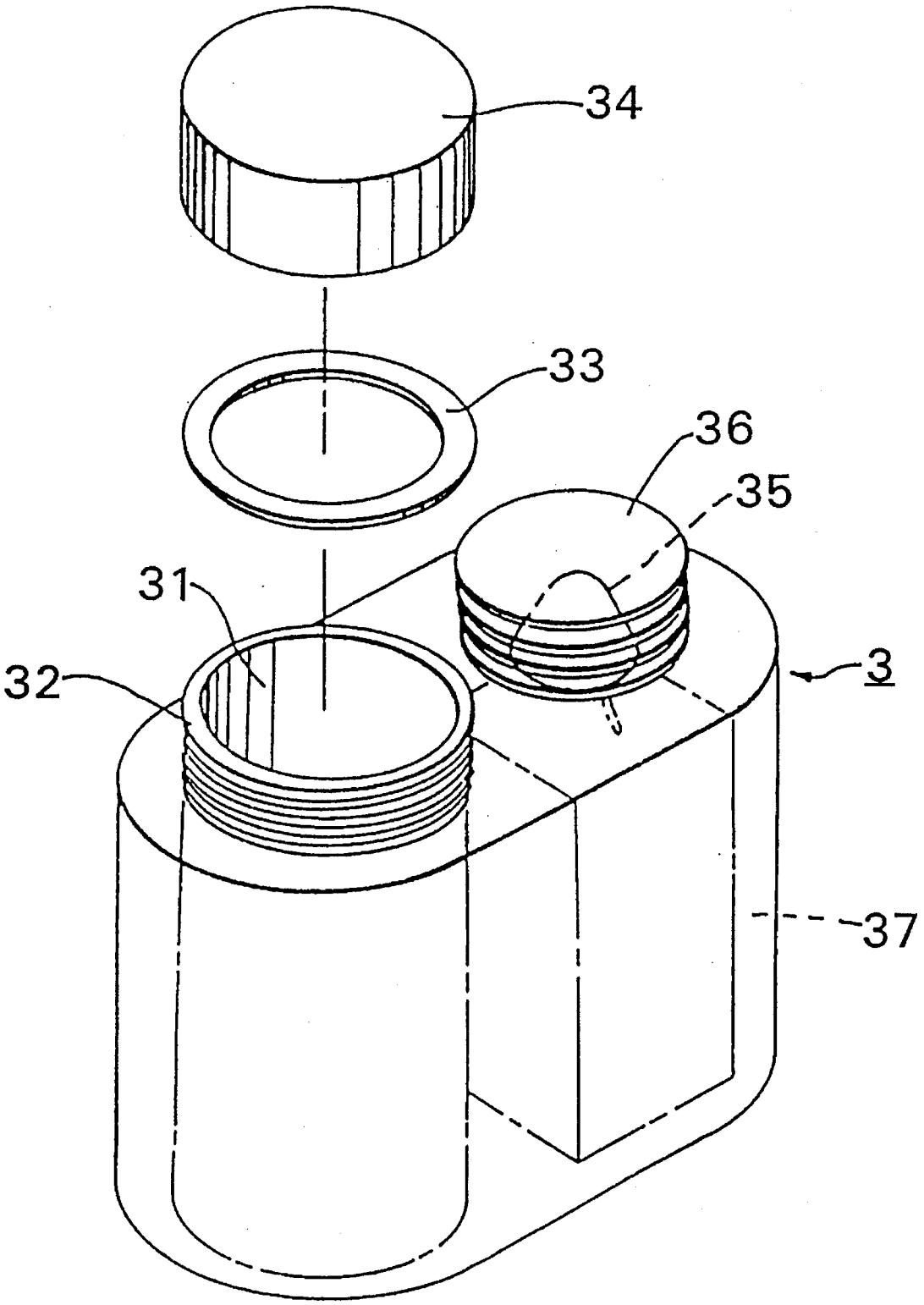
FIG. 3 is an isometric drawing of the battery case structure of the first preferred embodiment of the invention herein.

As indicated in FIG. 3, the aforementioned battery case (3) has a battery container (31) positioned at one side, and seated on the opening (32) of the aforesaid battery container (31) is an oil gasket (33) that is sealed by the fastening of a threaded cover (34), and protruding from the other side of the aforesaid battery case (3) is a switch (35) encapsulated in a rubber jacket (36), with the overall design thereby preventing the entry of water into the device; furthermore, the aforesaid switch (35) is interconnected to an electric current driver device (37) and electricity to the aforesaid electric current driver (37) is supplied by a battery inside the battery container (31), and the main function of the electric current driver (37) is to convert the direct current electricity from the battery into the alternating current electricity necessary to power the electroluminescent component (21).

Figure 4:
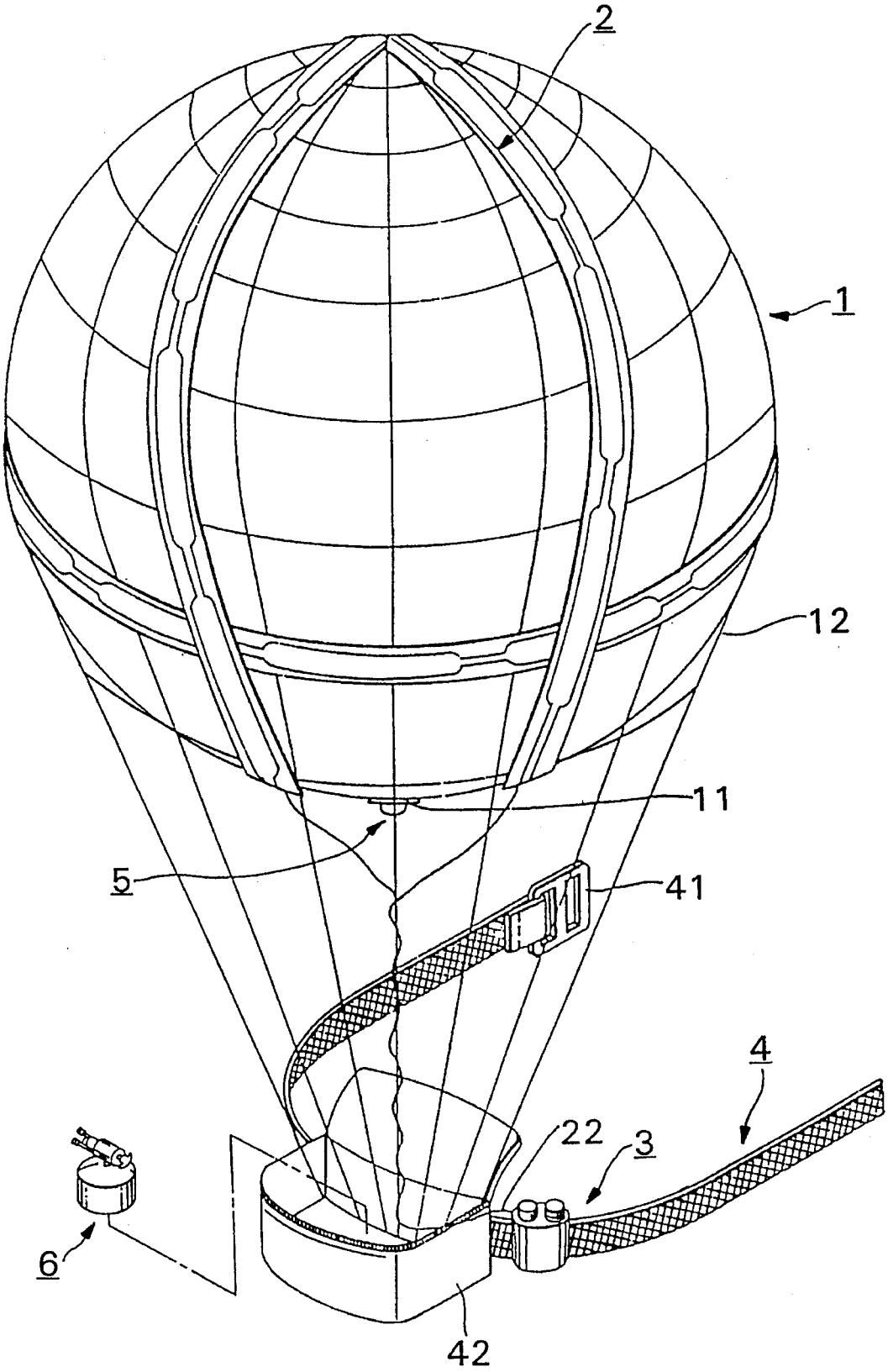
FIG. 4 is an isometric drawing of the second preferred embodiment of the invention herein.

As indicated in FIG. 4, the aforementioned securing belt (4) has buckle components (41) attached to both ends and, furthermore, there is a satchel (42) on the securing belt (4) and the string netting (12) enshrouding the external spherical surface of the inflatable balloon (1) is fastened to the satchel (42).

When the first preferred embodiment of the invention herein is utilized, the buckle component (41) is employed to fasten the securing belt (4) onto the waist or other suitable object, then the inflatable balloon (1) is removed and inflated through human exhalation until the inflatable balloon (1) is filled with air, which causes the inflatable balloon (1) to expand against the electroluminescent component (21) of the string netting (12) and thereby increase the positional visibility of the rescue victim and, furthermore, when the user is situated in water, the invention herein functions as a means of flotation for the rescue victim; furthermore, if the invention herein is utilized at night, then the switch (35) on the battery case (3) can be actuated to trigger light source emission from the electroluminescent component (21) and thereby enable the sighting of the location of the rescue victim from a considerable distance.

Figure 5:
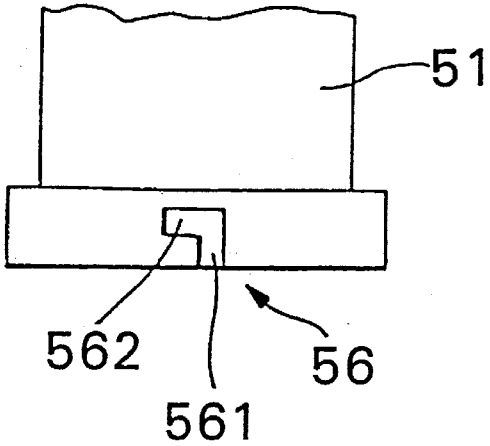
FIG. 5 is a cross-sectional drawing of the air inflation stem structure of the second preferred embodiment of the invention herein.
Figure 6:
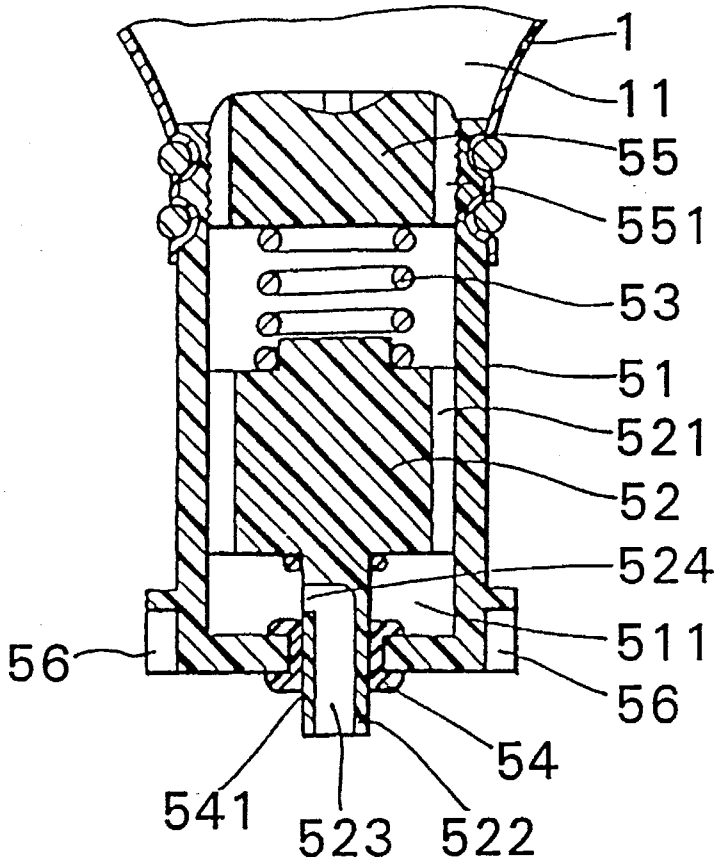
FIG. 6 is an orthographic drawing the catch slot structure in the tubular section of the air inflation stem of the second preferred embodiment of the invention herein.

As further indicated in FIG. 4, the second preferred embodiment of the life-saving assistance device (B) invention herein is similar to the first preferred embodiment of the invention herein in that aforesaid second preferred embodiment includes an inflatable balloon (1), an illumination emission source (2), a battery case (3) and a securing belt (4) and, furthermore, an air inflation stem (5) and an air inflation device (6), of which:

As indicated in FIG. 5, the aforementioned air inflation stem (5) is positioned at the air delivery opening (11) of the aforesaid inflatable balloon (1) and has a tubular section (51), and along the inner extent of the tubular section (51) is an air passage (521) having a valve (52); at one end is an air input tube (522) and at the other end is a tensile component (53); of which, there is an air input tube (522) through the tubular section (51), at one end of which is the axial hole (541) of a pliable grommet (54) and the tensile component (53) at the other end is screwed against the tubular section (51) that is, furthermore, retained by a bushing (55) positioned along the inner extent that has an air passage (551); at the same time, there is an air channel (523) inside the air input tube (522) of the valve (52) and, furthermore, the air channel (523) includes an air port (524) that is positioned on the air input tube (522); when the valve (52) is pushed due to the movement of the air input tube (522) and the compression of the tensile component (53), the air port (24) become contiguous with the air chamber (511) in between the tubular section (51) and valve (52) and, therefore, air is admitted through the air channel (523), the air port (524), the air chamber (511), the air passage (521) and the air passage (551) and thereby enter the inflatable balloon (1) through the air delivery opening (11) of the inflatable balloon (1); conversely, when no external force is applied to push the air input tube (522) inward, then tensile component (53) pushes downward against the air input tube (522) of the valve (52), causing the air port (524) to be sealed by the grommet (54) and, therefore, air cannot pass through the air channel (523); there are catch slots (56) on both sides of the tubular section (51) end where the grommet (54) is mounted and, as indicated in FIG. 6, the structure of the catch slots (56) is mainly comprised of a vertical guide section (561) and a horizontal lock section (562).

Figure 7:
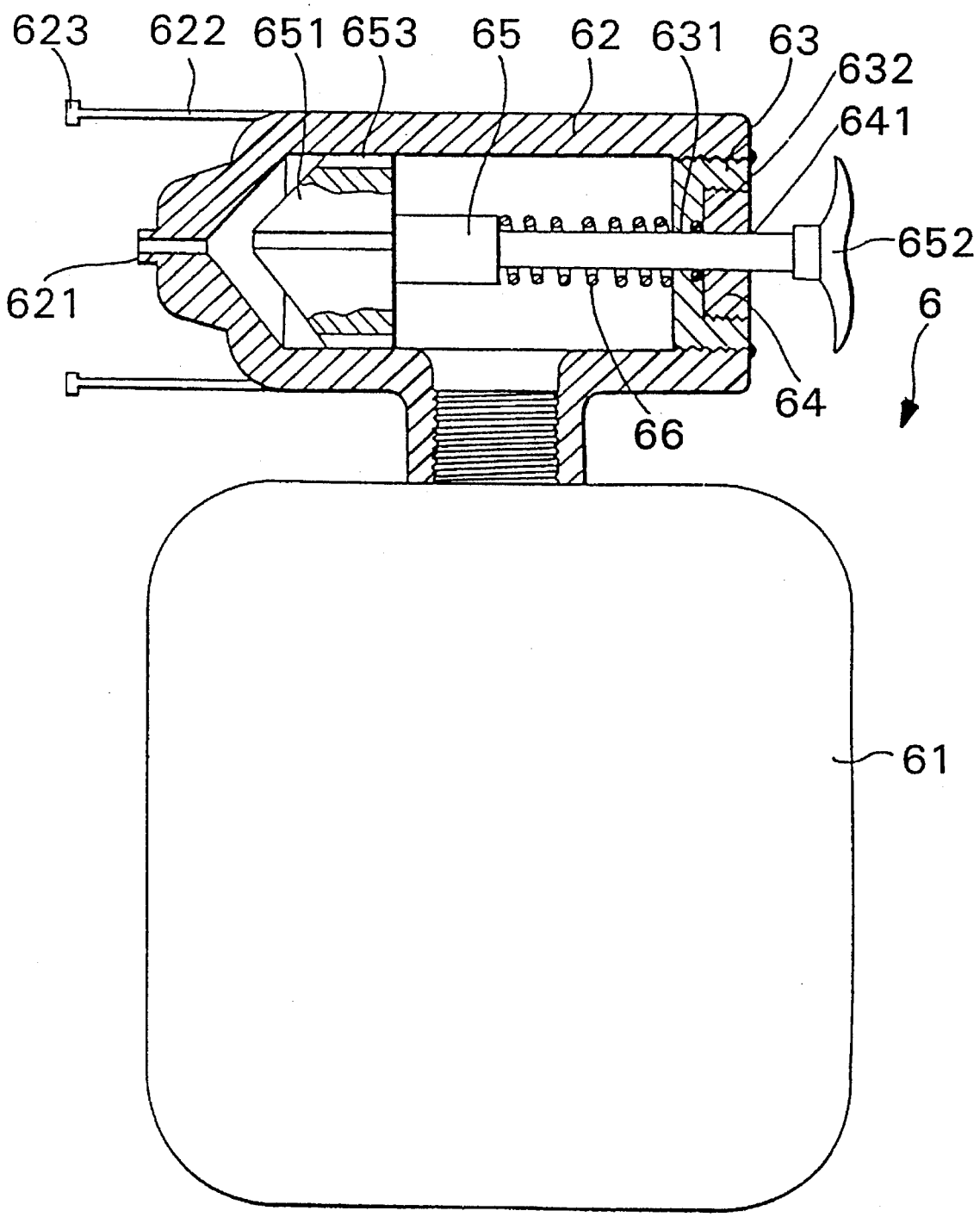
FIG. 7 is a partial cross-sectional drawing of the inflation device structure in the second preferred embodiment of the invention herein.
Figure 8:
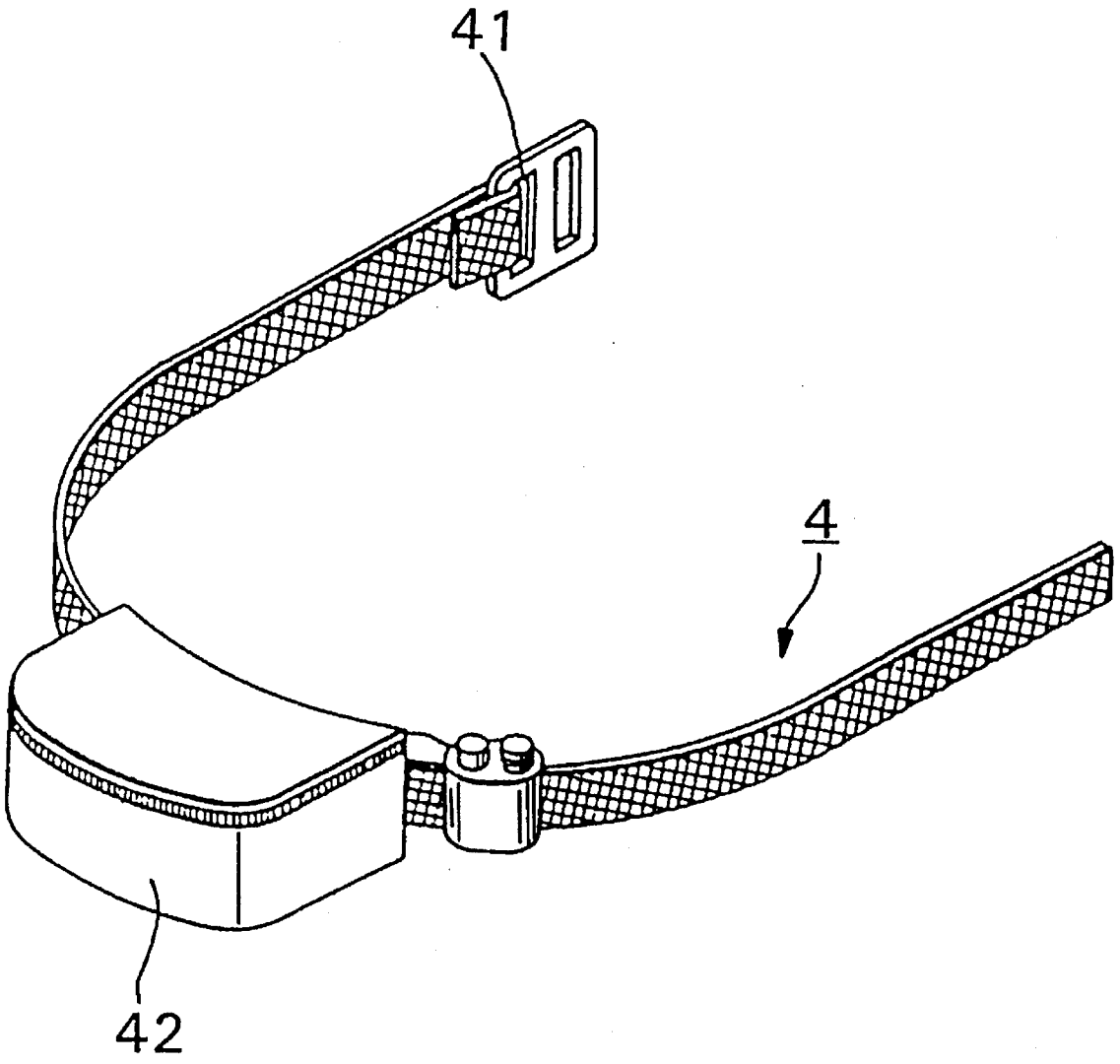
FIG. 8 is an isometric drawing of first and the second preferred embodiments of the invention herein in a completely folded state.

As indicated in FIG. 7, the aforementioned air inflation device (6) consists of a canister (61) containing a volume of compressed gaseous hydrogen sufficient enough to fill the aforementioned inflatable balloon (1) that has an inflation tube (62) at the upper extent, and at one end of the inflation tube (62) is an inflation nozzle (621); there are lock tabs (622) on the two sides of the inflation nozzle (621) and each lock tab (622) has protruding edges (623) at the ends; there is shaft hole (631) inside the threaded other end of the inflation tube (62) and, furthermore, the shaft hole (631) extends through the O-ring seal (532) mounting base (63) and, furthermore, a lock base (64) is screwed into and against the mounting base (63) to secure the O-ring seal (532); at the same time, there is a shaft hole (641) through the lock base (64); inside the inflation tube (62) is a plunger rod (65), wherein there is a tapered plug (651) at one end of the plunger rod (65) and a pull handle (652) at the other end; furthermore, there is a flow channel (653) in the outer extent of the plug (651) and there is a tensile component (66) in between the push tip of the plug (651) and inflation nozzle (621) of the inflation tube (62).

When the second preferred embodiment of the invention herein is utilized, the buckle component (41) is employed to fasten the securing belt (4) onto the waist or other suitable object, then the inflatable balloon (1) and the air inflation device (6) is removed and, as indicated in FIG. 5, FIG. 6 and FIG. 7, the lock tabs (622) of the air inflation device (6) are inserted into the catch slots (56) of the air inflation stem (5) on the inflatable balloon (1), at which time the inflation tube (62) on the air inflation device (6) is inserted into the air channel (523) of the air inflation stem (5), then pressure is exerted onto the inflation tube (62) to cause the movement of the protruding edges (623) of the lock tabs (622) into guide sections (561) at the lower ends of the catch slots (56), after which the rotation of the inflation tube (62) causes the protruding edges (623) to revolve into the lock sections (562) of the catch slots (56), at which time the inflation nozzle (621) of the inflation tube (62), due to the downward pressure of the air input tube (522), causing the internal movement of the air port (524) to become contiguous with the air chamber (511), then the pull handle (652) of the plunger rod (65) on the inflation tube (62) is pulled downward to the rear, whereupon the plug (651) is separated from the original sealed inflation nozzle (621) causing the release of the highly pressurized gaseous hydrogen in the canister (61) through the flow channels (653) on the outer extent of the plug (651), the inflation nozzle (621), the air channel (523) of the air inflation stem (5), the air port (524), the air chamber (511), the air passage (521) on the outer extent of the valve (52) and the air passage (551) on the outer extent of the bushing (55) to enter into the inflatable balloon (1); after the inflatable balloon (1) is completely filled with gaseous hydrogen, the pull handle (652) on the inflation tube (62) is pulled to cause the plug (651) to seal the inflation nozzle (621) and, furthermore, the inflation tube (62) is rotated a certain number of degrees to enable the protruding edges (623) on the lock tabs (622) separate from the catch slots (56), then since the inflation nozzle (621) of the inflation tube (62) is no longer inserted into the air input tube (522) of the air inflation stem (5) and, due to the decompressive force of the tensile component (53), the movement of the valve (52) relative to the air input tube (522) causes the air port (524) to slide into the grommet (54) such that the gaseous hydrogen filling the inflatable balloon (1) cannot leak; then, since the inflatable balloon (1) is completely filled with gaseous hydrogen, the inflatable balloon (1) rises upward to effectively drawing attention to the rescue victim and, furthermore, during the night, the switch (35) of the battery case (3) is actuated to trigger the electroluminescent component (21) to produce an illumination source, thereby enabling the long-distance visibility of the position where the rescue victim is located; furthermore, if the user is situated in water, the aforesaid inflatable balloon (1) functions as a means of flotation for the rescue victim.

Therefore, in view of the foregoing descriptions of the two preferred embodiments of the life-saving assistance device of the invention herein, the invention herein possesses the following advantages:

(1) The two preferred embodiments of the invention herein feature simplified operation and provides an inflatable balloon that inflates rapidly and floats in the air which can effectively indicate the exact location of rescue victims, thereby enabling rapid discovery by rescuers and, furthermore, significantly shortens the time required to locate rescue victims and the subsequent transportation to hospitals.

(2) The illumination source of the electroluminescent component of the two preferred embodiments of the invention herein can be utilized at night to effective increase the visibility of the inflatable balloon and, furthermore, the electroluminescent component is specially designed to consume electricity at a minimum rate and can thereby function as a source of illumination for extend periods until victims are rescued.

(3) The aforementioned inflatable balloon has flotation capability in water and can, therefore, serve as a life-saving float for rescue victims unable to swim.

(4) When the uninflated inflatable balloon and the air inflation device are packed in the satchel, as indicated in FIG. 7, the overall dimensions are minimum and virtually no space is occupied such that the satchel can be carried on the body by utilizing the aforementioned securing belt, or even fastened to a suitably exposed objects and, therefore, the two preferred embodiments of the invention herein offers utmost convenience.

(5) Although the inflatable balloon is incapable of ascending into the air when utilization involves inflation through physical exhalation, the visible area of display is still quite apparent as the outer surface of the inflatable balloon expands within the string netting and, furthermore, flotation capability is retained when the rescue victim is situated in water.

The description of the practical and preferred embodiments of the invention herein shall not be construed as a limitation on the disclosed embodiments therein, but simply an intent to present the range of possible configurations included within the general principles and overall scope relating to the broad interpretation and the analogous restructuring of the invention herein.

What is claimed is:

1. A life-saving assistance device comprised of:

an inflatable balloon including an air delivery opening and a surrounding shroud of string netting, the air delivery opening includes an air inflation stem having a tubular section equipped with a valve subject to the action of a tensile component, the valve containing an air passage, the tubular section further including an air input tube having an air channel and an air port, the air port, the valve and the air chamber of the tubular section being generally contiguous, the air inflation stem further including a bushing contacting the tubular section and the tensile component;

an illumination source including an electroluminescent component mounted on the string netting, the electroluminescent component including a wire extending therefrom for connection to an electric power source;

a battery case including a battery container, a cover, a current driver device and a switch;

a belt having buckle components attached to both ends with a satchel thereon wherein the inflatable balloon is contained within the satchel while in an uninflated state and the securing belt enables the fastening of the satchel to a user and wherein during utilization, the inflatable balloon is removed from the satchel for delivery of air into the inflatable balloon, the switch being employed to control the emission of lumination from the electroluminescent component; and an air inflation device including a canister containing pressurized gas with an air inflation tube extending outwardly therefrom, the air inflation tube including an inflation nozzle having a plunger rod sealed by a plug, the plunger rod engaging the tensile component of the valve for sealing the inflation nozzle, the plunger rod including a handle extending outwardly from the inflation tube whereby the inflatable balloon may be inflated by a user pulling the handle to move the plunger rod and open the valve such that air from the canister blows into the balloon.

2. The life-saving assistance device as recited in claim 1 wherein the air inflation stem further includes at least one catch slot on an outer surface thereof and wherein the inflation nozzle includes at least one lock tab or engaging the at least one catch slot for interconnecting the air inflation stem and the inflation nozzle.

* * * * *